United States Patent [19]

Frentzel

[11] Patent Number: 4,823,837

[45] Date of Patent: Apr. 25, 1989

[54] SKIMMER COVER PLATE

[75] Inventor: Herman E. Frentzel, Kentfield, Calif.

[73] Assignee: Arneson Products, Inc., Corte Madera, Calif.

[21] Appl. No.: 186,008

[22] Filed: Apr. 25, 1988

Related U.S. Application Data

[62] Division of Ser. No. 7,923, Jan. 28, 1987, Pat. No. 4,776,953.

[51] Int. Cl.[4] ..... F16K 31/12

[52] U.S. Cl. ..... 137/624.11; 251/230

[58] Field of Search ..... 137/624.11, 624.13, 137/624.14, 119; 251/230

[56] References Cited

U.S. PATENT DOCUMENTS

| | | | |
|---|---|---|---|
| 3,147,770 | 9/1964 | Perlis | 137/624.13 |
| 3,924,652 | 12/1975 | Kah | 137/119 |
| 4,034,775 | 7/1977 | Slagel | 137/119 |
| 4,109,670 | 8/1978 | Slagel | 137/119 |
| 4,526,186 | 7/1985 | Frentzel | 134/167 |

*Primary Examiner*—Alan Cohan

*Attorney, Agent, or Firm*—Limbach, Limbach & Sutton

[57] ABSTRACT

A skimmer cover plate is disclosed for use with a pool skimmer system. The skimmer cover plate allows the pool skimmer to work alternatively with an underwater suction operated pool cleaner. The skimmer cover plate is designed to seal the upper surface of the well of a skimmer. The hose of the suction cleaner is connectable to a pipe on the cover plate. The cover plate includes an indexable valve which is movable between two positions for varying the flow of fluid and debris from the pool directly into the well and basket of the pool skimmer. When fluid flow is restricted through the valve, the suction will be diverted to power the pool cleaner. When the valve is opened, debris will pass from the surface of the skimmer through the valve and into the basket for collection. An indexable valve is provided which indexes in response to the cycling of the pump.

8 Claims, 3 Drawing Sheets

SKIMMER COVER PLATE

This is a continuation divisional of application Ser. No. 007,923, filed Jan. 28, 1987 Pat. No. 4,776,953.

TECHNICAL FIELD

The subject invention is intended for use in conjunction with swimming pool cleaning systems. More specifically, a skimmer cover plate is disclosed which permits the alternate operation of a suction driven pool cleaner and a pool skimmer, with the skimmer basket being used to collect debris in either mode of operation.

BACKGROUND OF THE INVENTION

Most larger swimming pools, and, in particular, below ground pools include some form of built-in filtration and skimming system. A pump is provided for drawing water from the pool through various filters and strainers prior to returning the flow to the pool. A skimmer is usually provided for removing surface debris, such as floating leaves. Surface skimmers typically have an opening at the pool water level and are connected to the suction side of the pump such that surface water is drawn into the skimmer. This flow tends to draw surface debris into a collection basket within the skimmer enclosure.

Surface skimmers cannot remove debris which has settled to the bottom of the pool. In the past, pool owners would vacuum the bottom of the pool with a hose connected to the pump. More recently, a wide variety of pool-cleaning devices have been developed which operate automatically. Some of these devices float on the water and move around the pool circulating debris, forcing it towards the skimmer before it has a chance to sink to the bottom of the pool. A number of other devices have been introduced that are suction driven and move about the bottom of the pool. Examples of such devices are distributed by Arneson Products under the POOL VAC and AQUADROID trademarks.

The latter Arneson devices operate by connecting a flexible hose between the device and a suction source, typically the suction inlet in the skimmer. The suction source draws water through the device, powering internal turbines which enable the device to move around the pool bottom. Leaves and other debris at the bottom of the pool are sucked into the device and are passed out through the suction hose. Because the leaf basket in the skimmer must be removed to connect the suction hose to the suction inlet in the skimmer, an upstream leaf collector or trap is typically installed for catching the debris carried in the hose before it reaches the skimmer.

The underwater suction cleaners provide a very effective means for cleaning the bottom and walls of the pool. Unfortunately, because the hose is connected directly to the suction inlet in the skimmer, the skimmer is disabled while the device is in operation, such that floating debris will not be collected. In the past, pool owners have been required to manually connect and disconnect the cleaner's suction hose from the suction inlet to permit alternate operation of either the skimmer or the automatic pool cleaner.

In order to free the pool owner from this repetitive task, a valve was developed which automatically alternated the flow of fluid between the skimmer and the pool cleaner. This valve is described in U.S. patent application, No. 737,521, filed May 24, 1985, and now U.S. Pat. No. 4,643,217, issued Feb. 17, 1987, assigned to the same assignee as the subject invention and incorporated herein by reference. The indexable valve described therein fits into the suction inlet at the skimmer and receives the suction hose connected to the underwater pool cleaner. The indexable valve had two principal operating positions. In the first position, the valve was arranged to allow fluid to be drawn through the suction hose directly into the suction inlet. In a second position, fluid was allowed to pass into the valve directly from the skimmer. The valve indexed through a sequentially intermediate position whenever the skimmer pump was turned off.

The indexable valve described in the latter patent application operated quite well with existing time controlled filter systems. More specifically, most pool filtration systems operate on timers which cycle on and off during the twenty-four hour day. In fact, it has been shown that most efficient filtration occurs when the total operating time is broken down into a number of short cycles spread out during the day, rather than fewer, longer cycles. The indexable valve was designed such that every time the filtration system is turned off, the valve would shift through its intermediary position, to one of either the first or second positions. In this manner, the pool would alternately be skimmed or vacuumed automatically, throughout the day, without any intervention from the pool owner.

In the arrangement described above, wherein the suction hose is connected to the suction inlet of the skimmer via the valve, an intermediary leaf trap is mounted upstream from the suction inlet to collect the leaves before they pass into the skimmer. The separate leaf trap is necessary because the typical lint and hair screen at the pump has a very low collection capacity and can be difficult to reach and clean. In addition, when the screen is cleaned, suction is sometimes broken requiring the pool owner to reprime the pump.

Unfortunately, the use of a separate leaf trap has not been found to be particulary desirable since they are more difficult to clean than the standard skimmer basket. In addition, the pool owners have grown accustomed to and are more comfortable servicing a standard skimmer basket. Finally, the leaf trap typically is located in the water mounted between sections of the suction hose detracting from the visual esthetics of the pool.

Accordingly, it would be desirable to provide a device which would allow an automatic indexable valve to be utilized in conjunction with the leaf basket in the skimmer. A partial solution to the problem would be to design a basket which has an opening to receive the suction hose. Properly configured, the basket would collect debris when the skimmer was operating. Unfortunately, when the underwater pool cleaner was operated, the fluid flow would still be channeled directly to the suction inlet in the skimmer, bypassing the basket. In addition, the pool owner would still be faced with connecting the valve to the suction inlet of the skimmer. Since the inlet openings in various skimmers tend to have different configurations, a variety of adapters are necessary to ensure compatibility of the valve with the inlet.

Accordingly, it is an object of the subject invention to provide a new and improved device which may be used in conjunction with a pool skimmer and an underwater pool cleaner.

It is another object of the subject invention to provide a new and improved device which will allow an underwater suction powered pool cleaner device to be used in conjunction with the pool skimmer without disabling the skimmer.

It is a further object of the subject invention to provide a skimmer cover plate mountable to a skimmer for receiving the suction hose of an underwater pool cleaner.

It is still a further object of the subject invention to provide a skimmer cover plate which can be mounted on a pool skimmer that includes an indexable valve, allowing alternate operation between an underwater pool cleaner and the skimmer system.

It is still another object of the subject invention to provide a skimmer cover plate which is mountable to a skimmer and allows the leaf collecting basket to be utilized in conjunction with both the skimmer and the underwater suction operated pool cleaner.

It is still another object of the subject invention to provide a skimmer cover plate which resists being dislodged by back pressure.

It is still a further object of the subject invention to provide a new and improved indexable valve.

It is still another object of the subject invention to provide a new and improved indexable valve which is mountable to a skimmer cover plate.

It is still a further object of the subject invention to provide a new and improved indexable valve with improved operation.

SUMMARY OF THE INVENTION

In accordance with these and many other objects, the subject invention is intended to be used with a swimming pool having a suction skimmer system. The skimmer typically includes a well with a suction inlet. The upper surface of the well is below the water level of the pool. A perforated, debris-collecting basket is mounted in the well. In this configuration, the pump draws water and floating debris into the skimmer, straining the water through the basket. The pool owner can empty the basket at regular intervals.

As mentioned above, there are a number of suction powered underwater pool cleaners now on the market. Examples of such cleaners are marketed by Arneson Products, Inc. under the trademarks POOL VAC and AQUADROID. All of these devices include a suction hose extending from the cleaner to a suction source. If the suction hose is connected directly to the suction inlet in the skimmer, the debris collection basket had to be removed. Once the basket was removed, it was necessary to provide some other leaf trap along the fluid path to the pump.

The additional leaf trap is not required when the skimmer cover plate of the subject invention is utilized. More particularly, the skimmer cover plate of the subject invention includes a plate member having a configuration designed to seal the upper surface of the well. Preferably, a rubber gasket is provided to enhance sealing and provide for some irregularities in the circumference of the well. A means is provided to connect the suction hose from the pool cleaner to the plate, such that it is in communication with the well of the skimmer.

The skimmer cover plate further includes an indexable valve movable between two primary positions. In one position, the fluid flow is restricted through the valve such that the suction generated in the well is diverted to power the underwater pool cleaner. When the valve is in the second position, fluid and debris are drawn directly through the valve and into the well. In both cases, water passing through either the hose or the valve is strained through the debris basket.

The indexable valve utilized in the subject cover plate is of the type described in U.S. patent application No. 737,521, cited above. This valve includes a spring-biased piston which is movable between the first and second positions through a sequentially intermediate position. As described in detail below, when the fluid flow in the skimmer is interrupted, typically when the pump is shut off, the piston is urged into the intermediate position by a spring. When the fluid flow is once again activated, the piston is drawn into one of two positions, one of which restricts the fluid flow through the valve. As discussed in greater detail below, the indexable valve described in this specification contains some design improvements which enhance its operability.

Further objects and advantages of the subject invention will become apparent from the following detailed description taken in conjunction with the drawings in which:

DETAILED DESCRIPTION OF THE PREFERRED EMBODIMENT

Figure 1:
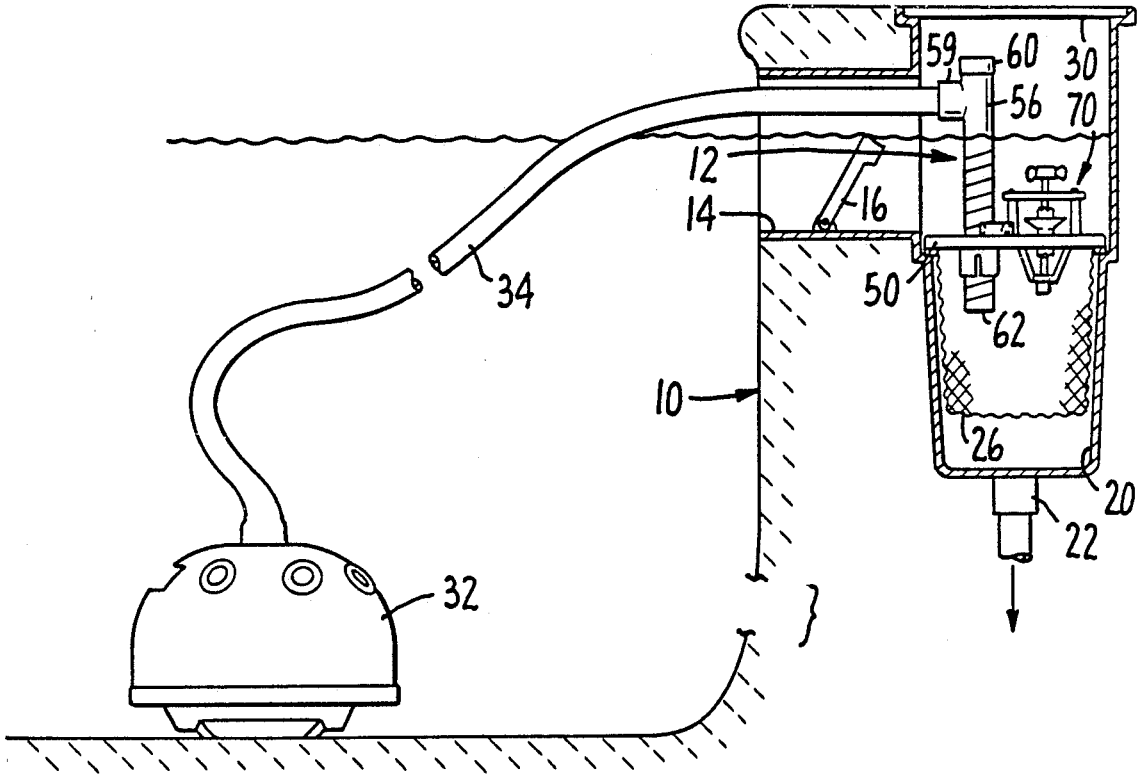
FIGS. 1 is a side elevational view, partially in section, of a swimming pool showing an underwater suction-operated pool cleaner connected to a skimmer having a well and basket and showing the skimmer cover plate mounted thereon.

Referring first to FIG. 1, there is illustrated a typical swimming pool structure 10 having skimmer system. The skimmer 12 of the skimmer system is built into the side of the pool 10. A channel 14 provides a fluid path from the swimming pool to the well 20 of the skimmer. A weir 16 is pivotally mounted in channel 14 to enhance the surface skimming action. A suction inlet 22 is provided at the bottom of well 20. The suction inlet 22 is connected to a pump (not shown) for drawing water in through the channel 14 and into the well.

The skimmer is further provided with a perforated basket 26 for catching leaves and other debris. In operation, the water at the upper surface of the pool is drawn in over weir 16 and filtered through basket 26. An easily removable lid 30 is provided on top of the skimmer to permit the pool owner to frequently reach in and empty basket 26 of the collected debris.

As mentioned above, even in pools having a surface skimming device, it was still necessary for the pool owner to vacuum the bottom of the pool. Recently, there have been developed a variety of suction-operated underwater pool cleaners which are powered by the suction of the skimmer thereby freeing the pool owner from having to separately vacuum the pool.

FIG. 1 illustrates the outer configuration of one such underwater pool cleaning device 32 marketed under the trademark AQUADROID by Arneson Products, Inc. In operation, suction is applied to the device 32 through a suction hose 34. Fluid drawn through the device 32 provides the power that enables the device to move about the pool surfaces collecting debris. The debris is drawn up through the hose 34 into the pool skimmer.

When suction operated pool cleaners were first introduced, one common mode of operation was to connect the hose directly to the suction inlet 22 at the bottom of the well 20 of the skimmer 12. This connection disabled the operation of the skimmer unit and prevented the removal of floating debris. The problem of disabling the skimmer was overcome by the development of an automatic indexable valve described in above-cited U.S. patent application 737,521. The skimmer cover plate of the subject invention utilizes a similar indexable valve to gain the further advantage of allowing the filter basket 26 to be used for both the skimming and underwater pool cleaner operation. In addition, no special adapters are required to permit direct connection between the valve and skimmer inlet.

Figure 3:
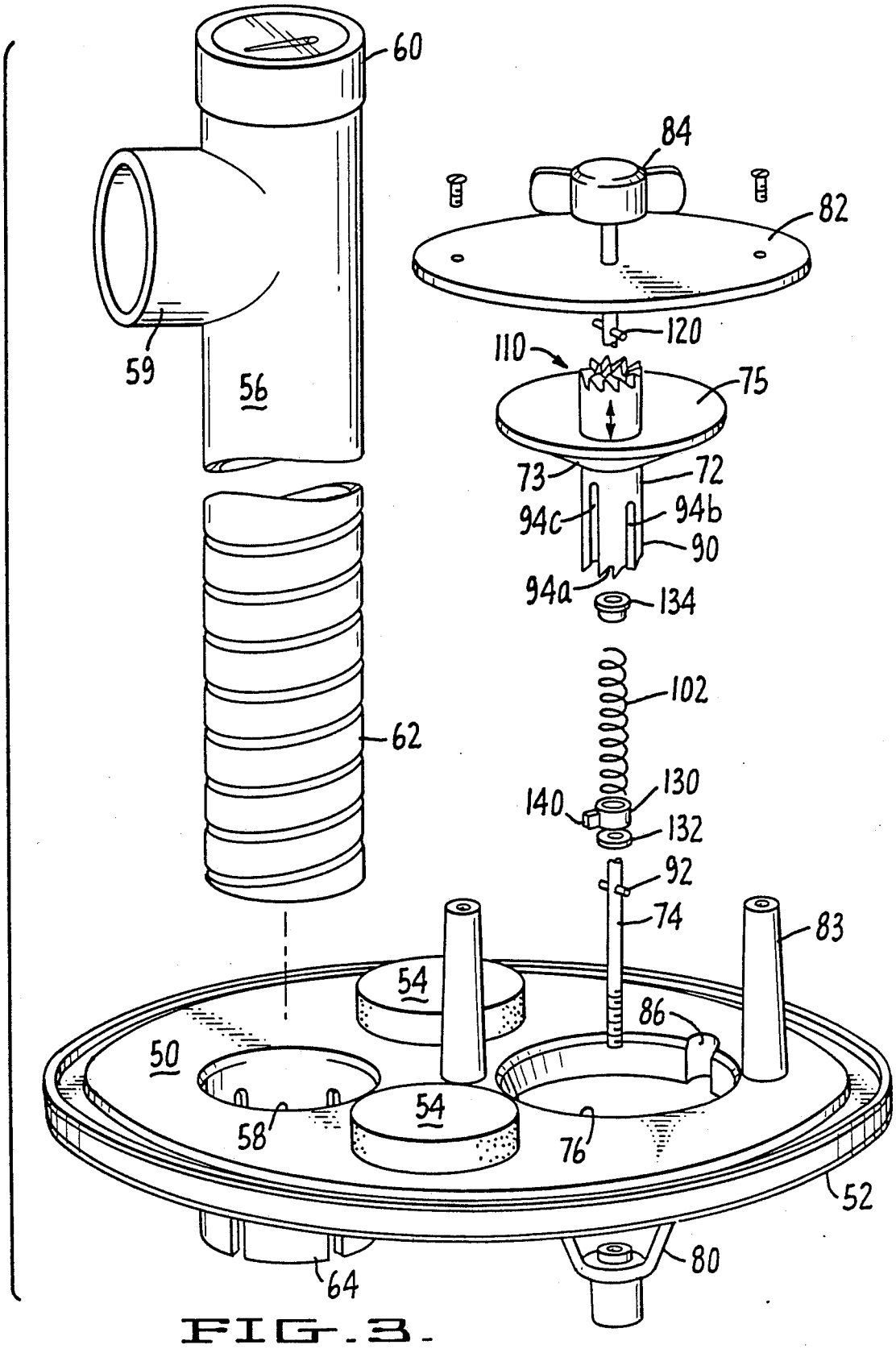
FIG. 3 is an exploded perspective view of the skimmer cover plate of the subject invention.

As shown in FIG. 3, the skimmer cover plate includes a plate member 50 having an outer configuration design to drop in over the rim of the basket 26 and seal the well 20 of the skimmer. A gasket 52 is provided on the lower surface of the plate member to enhance the sealing. This gasket can be designed to project beyond the radially outer periphery of the plate member 50 to accommodate some variation in size and the diameter of the well 20. A pair of weights 54 can be mounted on the cover plate to further enhance the seal.

The plate member 50 includes a means for connecting the hose 34 of the pool cleaner to the well. As illustrated in FIG. 3, a vertically upstanding pipe 56 is provided which is received in an aperture 58 in the plate. The upper end of the pipe 56 includes a female coupling 59 for receiving the male end of hose 34. In the preferred embodiment, a vacuum gauge 60 is formed integrally with the pipe to facilitate the adjustment of the valve as described below. The gauge is designed to read between 0 and 30 inches mercury. If desired, a thermometer (not shown) could be added to the plate to monitor the temperature of the water.

Pipe 56 is adjustably mounted to the plate member 50. In the illustrated embodiment, adjustability is achieved by threading the lower end of the pipe at 62. The lower end 62 of the pipe is received in a downwardly projecting pipe section 64 formed integrally with the plate member 50. The downwardly projecting pipe section 64 adds stability to the pipe mounting. The inner surface of the downwardly projecting section 64 is also threaded.

In use, the height of the pipe should be adjusted such that the end of the hose 34 is spaced above the water line, as illustrated in FIG. 1. By this arrangement, the hose 34 will not impede the operation of the weir 16. In addition, by wedging the hose against the upper surface of opening 14, the likelihood of the cover plate becoming dislodged from a possible backward surge of water is diminished. When the hose is connected in the manner as shown in FIG. 1, fluid can be drawn through the pool cleaner 32, hose 34, pipe 56, and into basket 26 where the debris can be strained prior to the fluid entering suction inlet 22.

In accordance with the subject invention, the skimmer cover plate is also provided with a valve means which allows for alternate operation between the underwater pool cleaner and the skimmer. This result is achieved through the use of an indexable valve 70. The indexable valve 70 includes a piston 72 having a conically shaped sealing surface 73 and an upper bearing surface 75.

The piston 72 is journalled about a central rod 74. The central rod 74 passes through an orifice 76 formed in the plate member 50. Orifice 76 defines an alternate fluid path for the water. When the valve is closed and the fluid flow is restricted through orifice 76, the majority of the fluid flow will pass through pipe 56, thereby powering the underwater pool cleaner. In contrast, when the valve is opened, most of the fluid flow will pass through the path of least resistance, that is, over the weir, through orifice 76, and into the well 20.

In the preferred embodiment of the subject invention, valve 70 is automatically indexable such that the pool owner does not have to make the change between the two operating modes. The valve takes advantage of the fact that most pool skimmer systems are controlled by a timer such that the pump cycles on and off periodically throughout the day. The changes in fluid flow in the skimmer which occur during the cycling of the pump are used to index the valve between opened and closed positions. A variety of indexable valves have been developed in the prior art. The illustrated indexable valve is similar to the one described in prior U.S. patent application No. 737,521.

Figure 2:
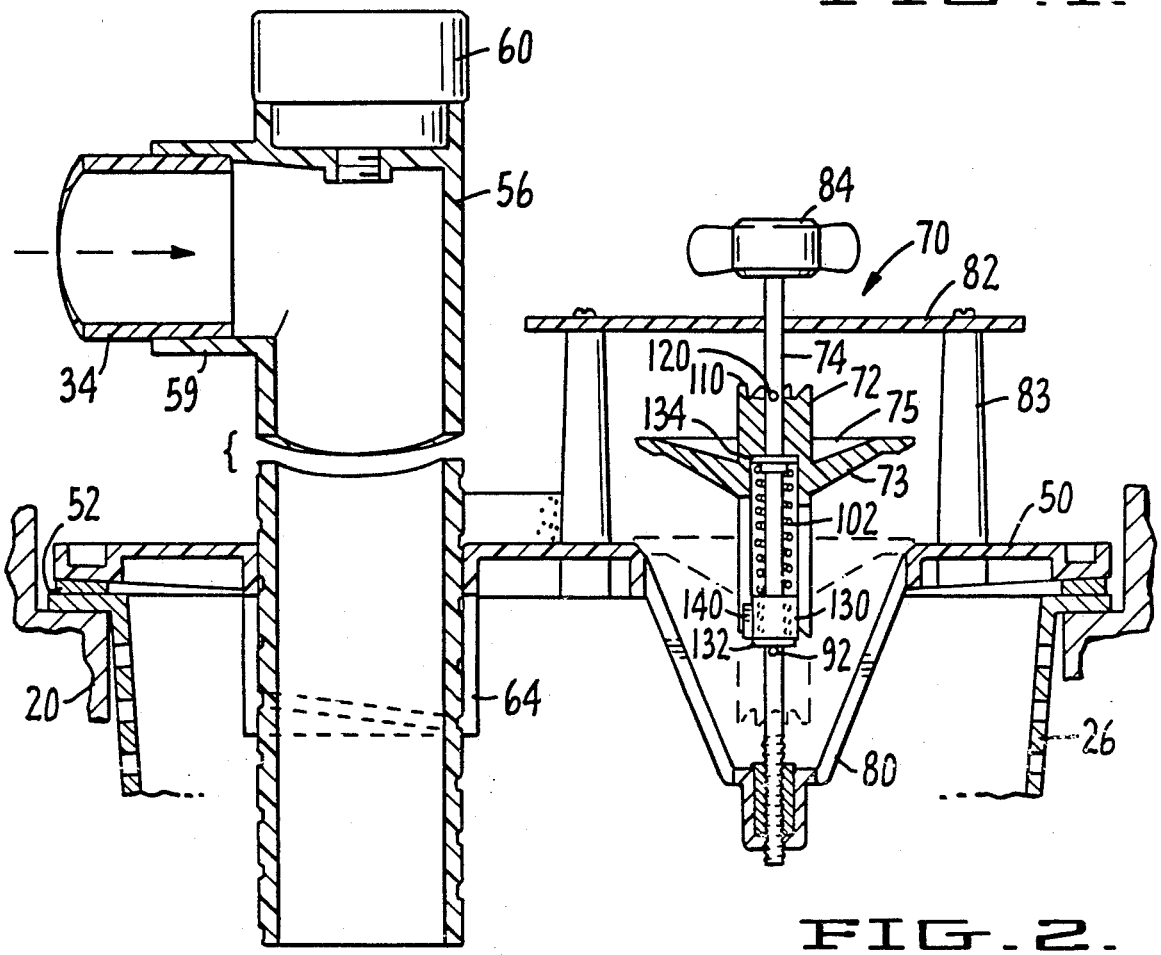
FIG. 2 is a cross-sectional view of the skimmer cover plate of the subject invention with the piston of the indexable valve being located in the upper, sequentially intermediate position.
Figure 4:
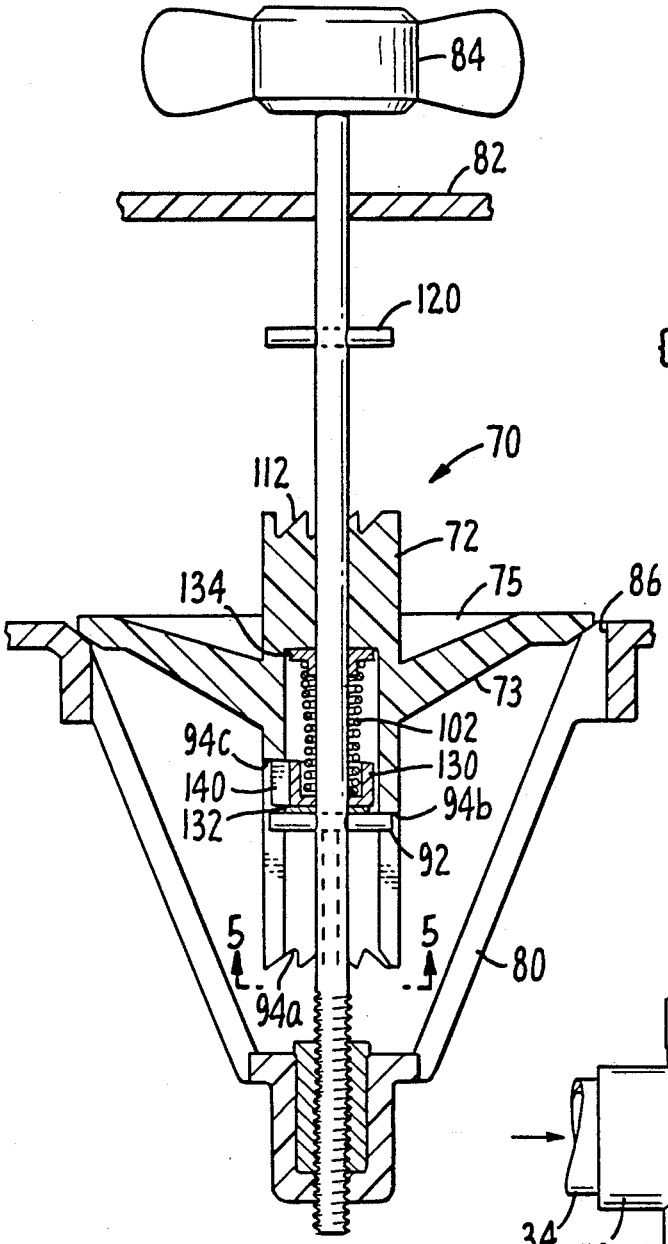
FIG. 4 is a cross-sectional view of the indexable valve of the subject invention with the piston shown in the closed or restricted position.

Referring to FIGS. 2 through 4, it will be seen that a means is provided for mounting the central rod 74 with respect to the orifice 76. The lower end of rod 74 is threadably received in a lower support member 80. The upper end of the rod is received in an aperture formed in a disc 82. Disc 82 is mounted to a pair of upstanding spacers 83 formed on the upper surface of plate member 50. Disc 82 also functions as an antivortex device to prevent vacuum breaking air from entering the system if the pool water level drops too low. The upper end of rod 74 is provided with a hand knob 84. By rotating knob 84, the vertical position of the central rod can be adjusted. By raising and lowering the rod, the end of stop position of the piston 72 can be varied to some extent with respect to orifice 76.

The latter feature is principally utilized to properly adjust the vacuum level supplied to operate cleaner 32. More specifically, when the piston is in the downward closed position as shown in FIG. 4, all the fluid flow will be channeled to the cleaner. If the pressure generated by the pump is greater than the level recommended by the cleaner manufacturer, (in the case of the POOL VAC the recommended pressure is between 8 and 12 inches of mercury while with the AQUADROID the recommended pressure is between 4 and 8 inches of mercury) the rod 74 can be raised, raising the sealing surface 73 away from orifice 76 and reducing the pressure to the cleaner.

In the preferred embodiment, orifice 76 is provided with a notch 86, as shown in FIG. 3. Notch 86 defines a bypass channel for fluid flow even if the valve is fully closed as shown in FIG. 4. By this arrangement, if the hose 34 from the pool cleaner ever becomes clogged, fluid will still be able to flow through notch 86 into well 20. This alternate flow eliminates the possibility of burning out the pump should the hose 34 become blocked.

Figure 6:
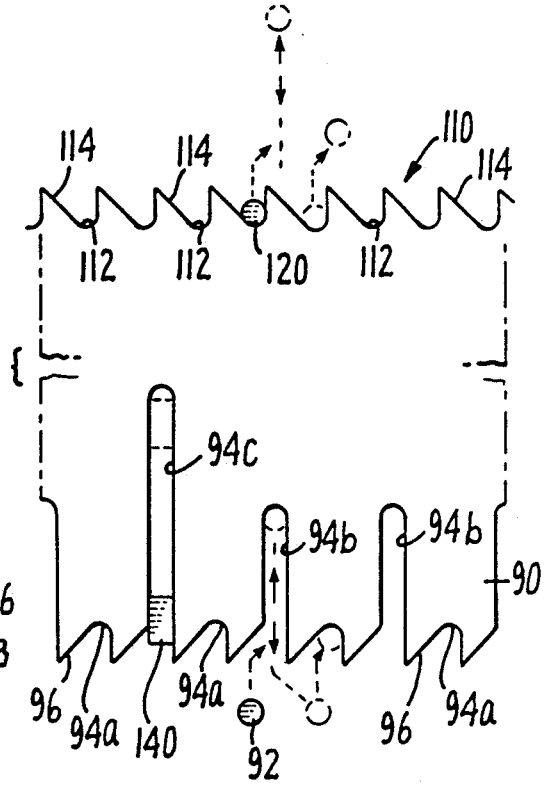
FIG. 6 is a time sequential layout view of the cammed surface and slots formed in the piston of the subject invention.
Figure 5:
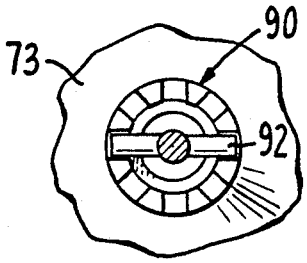
FIG. 5 is a cross-sectional view taken along the line 5—5 of FIG. 4.

The principal position of the valve 72 with respect to the orifice 76 is governed by the engagement of a stop pin 92 formed integrally with central rod 74 and the slots of the cammed surface 90 formed on the lower end of piston 72. As illustrated in FIG. 6, the lower cammed surface 90 includes slots 94A and 94B of alternate depths. One slot 94C is also provided at a location where a slot 94B would normally be located. The slot 94C is longer than the slots 94B. The purpose of elongated slot 94C will be discussed below. It should also be noted that slots 94 include angled surfaces 96 to facilitate the rotation of the piston.

As illustrated in the figures, a biasing means, in the form of a coiled spring 102, is mounted around the central rod 74 and located within a recess formed in the piston 72. The coiled spring 102 tends to bias the piston upwardly a distance sufficient to disengage pin 92 from the slots 94. When the pump is turned on and a fluid flow is established, fluid impinging on bearing surface 75 will drive piston 72 downwardly such that the pin will engage in one of the sets of slots 94A or 94B.

Figure 7:
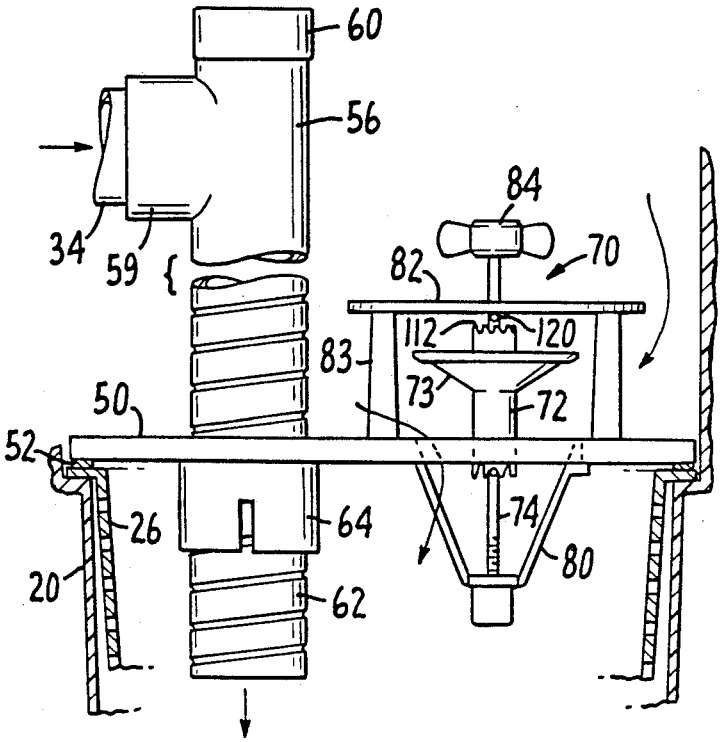
FIG. 7 is a side elevational view of the skimmer cover plate of the subject invention showing the piston of the indexable valve in the open position.

If the pin becomes engaged with one of the shorter slots 94A, the downward motion of the piston will be arrested and it will remain in the position shown in FIG. 7. In this position, the fluid flow will be primarily through the orifice 76. When the system timer causes the pump to be shut down, the fluid flow in the well will be reduced such that spring 102 can force the piston upwardly to a position as shown in FIG. 2. At this time, pin 92 will be disengaged from slots 94 in the piston. One advantage to this design is that the valve provides a mechanism to relieve back pressure in the well. Frequently, when the pump is turned off, air which has been compressed in the filter system can rapidly expand creating a back flow of fluid that could dislodge the plate from its position in the skimmer. In the subject design, any back pressure will first cause the piston to rise, opening the valve and providing a channel for the reverse flow of fluid.

When the timer cycle restarts the pump, and fluid is again drawn into the skimmer, the piston will be driven down such that pin 92 will be engaged in the next successive slot. When the pin is engaged in a longer slot, 94B, the piston will be in closed position, as illustrated in FIG. 4 (and in phantom line in FIG. 2). In this position, the sealing surface 73 of the piston cooperates with the periphery of the orifice 76 to restrict fluid flow through the orifice. As mentioned above, the level of sealing can be moderated by rotating rod 74 and raising piston 72.

The rotation or indexing of the piston can be enhanced by the addition of a second cammed surface 110 at the upper end of the piston. The slots 112 in the cammed surface 110 are all of equal length and have angled portions 114 similar to the angled portions on the lower cammed surface. A pin 120 is provided at the upper end of the central rod for engaging with the upper cammed surface.

The indexable valve described above is functionally equivalent to the valve described in prior U.S. patent application No. 737,521. Since the introduction of the latter valve, an enhancement was developed to further improve reliability. More specifically, it was found that when the original valve was indexed, the coiled spring could become twisted. The twisting of the spring built up a torque which resisted the further rotational movement of the valve during the cycling procedure.

In order to eliminate any twisting of the spring, the illustrated embodiment of the indexable valve includes a means for preventing the relative rotational movement between the coiled spring and the piston. In this manner, the spring will always rotate with the piston and no unwanted torque will be developed.

As best seen in FIGS. 3 and 4, the means for limiting this relative rotational movement consists of providing a ring 130 journalled about the rod 74 above pin 92. One or more spacers 132 may be mounted between the ring 130 and the pin 92. A corresponding ring 134 may also be mounted about the rod within the interior of the piston for receiving the upper end of the spring 102.

Ring 130 is provided with a projecting key 14. The projecting key is adapted to be received in a dedicated slot 94C, shown in FIGS. 4 and 6. Key 140 will ride up and down within the elongated slot 94C during operation of the valve. Ring 130 is positioned on rod 74 in a location which insures that key 140 will never come out of slot 94. The lower end of spring 102 is mounted within the ring 130, such that the spring will be carried around the central rod along with the piston.

In the preferred embodiment, the length of all diametrically opposed pairs of slots 94 (i.e., slots that are radially spaced apart by 180 degrees) are equal. The ends of pin 92 are engaged sequentially in opposed pairs of slots. The provision of elongated slot 94C results in the only exception to this pattern. When one end of pin 92 is aligned with slot 94C, the standard slot 94B, spaced 180 degrees away from slot 94C, controls the downward movement of the piston, as shown in FIG. 4.

The homeowner can readily install the subject skimmer cover plate. More specifically, the lid 30 is removed and the skimmer cover plate 50 of the subject invention is laid down such that gasket 52 seals the well 20. The free end of the suction hose 34 is connected to coupling 59 of pipe 56. The height of the pipe is adjusted such that hose 34 clears weir 16 and presses against the upper surface of the channel 14. The unit is now operational.

When the pump is actuated, fluid flow in the skimmer will draw the valve into one of the two downward positions. When the valve moves into the lower of the two positions, (FIG. 4) the flow through orifice 76 will be substantially restricted such that underwater pool cleaner will be operational. The throw of the central rod 74 can then be varied such that the desired vacuum level is supplied to the underwater pool cleaner. The vacuum level can be read on valve 60. When the pump is turned off by the timer, the valve will move to the sequentially intermediate upper position shown in FIG. 2. When the pump is again actuated, the valve will move downwardly to the alternate position shown in FIG. 7, allowing leaves and other debris skimmed from the surface of the water to enter the perforated basket 26 located the well 20. At regular intervals, the pool owner can raise the cover plate 50 and empty the contents of basket 26. As can be appreciated, the subject skimmer cover plate provides automatic, alternate operation between the skimmer and pool cleaner on a daily basis.

While the subject invention has been described with reference to a preferred embodiment, it should be understood that other changes and modifications could be made therein by one skilled in the art without varying from the scope and spirit of the subject invention as defined by the appended claims.

I claim:

1. An automatic valve for restricting fluid flow through an orifice comprising:

a central rod aligned with and passing through said orifice;

support means for maintaining the position of said central rod with respect to said orifice;

a piston journalled about said central rod and mounted for reciprocal movement between first, second and third positions along the length of said rod, said piston carrying a sealing means configured to restrict fluid flow through said orifice when the piston is in the first position and to permit fluid flow through said orifice when the piston is in the second position;

means for providing automatic indexing of said piston between said first and second positions in response to the nonuniform flow of fluid, said means including a first cammed surface at one end of said piston and formed integrally therewith, said cammed surface including a plurality of radially spaced slots, said means further including a stop pin receivable in one of said slots when the piston is in one of the first or second positions, with the selection of said first and second positions being governed by the length of the particular slot within which the pin is presently engaged, said means further including a coiled spring journalled about said central rod for urging the piston towards said third position when the fluid flow is lessened thereby disengaging the pin from a slot, and with said cammed surface being configured such that when the fluid flow is increased and the piston moves towards said first and second positions, the pin will become engaged with the next successive slot, and means for limiting the relative rotational movement between said coiled spring and said piston as said piston is indexed.

2. An automatic valve as recited in claim 1 wherein said means for limiting the rotational movement between said spring and said piston includes a ring connected to said spring and journalled about said central rod, said ring including a projecting key, and with said piston including a dedicated slot for slidably receiving the key.

3. An automatic valve as recited in claim 1 wherein said means for indexing further includes a second cammed surface located the other end of said piston, said second cammed surface having slots offset from the slots in said first surface, said indexing means further including a second stop pin arranged to engage with one of the slots in the second cammed surface when said piston means is in the third position.

4. An automatic valve as recited in claim 3 wherein the cammed surfaces include angle portions to facilitate the rotation of the piston.

5. An automatic valve as recited in claim 1 wherein said stop pin is formed integrally with said central rod.

6. An automatic valve as recited in claim 1 wherein said sealing means of said piston includes a conically shaped surface.

7. An automatic valve as recited in claim 1 further including a means for adjusting the position of the central rod with respect to the orifice to vary the location of the piston with respect to the orifice.

8. An automatic valve as recited in claim 1 wherein said piston further includes a bearing surface upon which the flow of fluid will cause the piston to move from said third position towards one of said first and second positions.

* * * * *